US009127240B2

(12) United States Patent
Demeyere et al.

(10) Patent No.: US 9,127,240 B2
(45) Date of Patent: Sep. 8, 2015

(54) PROCESS TO INTRODUCE HYDROPHOBIC ANTIBACTERIAL COMPOUND IN AN AQUEOUS COMPOSITION

(71) Applicant: The Procter & Gamble Company, Cincinnati, OH (US)

(72) Inventors: Hugo Jean Marie Demeyere, Merchtem (BE); Pieter Jan Maria Saveyn, Heusden (BE)

(73) Assignee: The Procter & Gamble Company, Cincinnati, OH (US)

( * ) Notice: Subject to any disclaimer, the term of this patent is extended or adjusted under 35 U.S.C. 154(b) by 49 days.

(21) Appl. No.: 14/025,881

(22) Filed: Sep. 13, 2013

(65) Prior Publication Data

US 2014/0080750 A1 Mar. 20, 2014

(30) Foreign Application Priority Data

Sep. 14, 2012 (EP) ..... 12184377
Sep. 14, 2012 (EP) ..... 12184483
Dec. 28, 2012 (EP) ..... 12199651

(51) Int. Cl.

| | |
|---|---|
| ***C11D 3/50*** | (2006.01) |
| ***C11D 3/48*** | (2006.01) |
| ***D06M 13/00*** | (2006.01) |
| ***D06M 23/12*** | (2006.01) |
| ***D06M 16/00*** | (2006.01) |
| ***C11D 3/22*** | (2006.01) |
| ***C11D 3/37*** | (2006.01) |
| ***C11D 17/00*** | (2006.01) |

(52) U.S. Cl.

CPC ..... *C11D 3/505* (2013.01); *C11D 3/227* (2013.01); *C11D 3/3773* (2013.01); *C11D 3/3796* (2013.01); *C11D 3/48* (2013.01); *C11D 3/50* (2013.01); *C11D 17/003* (2013.01); *D06M 13/005* (2013.01); *D06M 16/00* (2013.01); *D06M 23/12* (2013.01)

(58) Field of Classification Search

CPC ..... C11D 3/0026; C11D 3/50; C11D 3/502; C11D 3/505; C11D 3/48; C11D 3/485; C11D 11/0017

See application file for complete search history.

(56) References Cited

U.S. PATENT DOCUMENTS

| | | | |
|---|---|---|---|
| 2,954,347 | A | 9/1960 | St. John et al. |
| 4,022,938 | A | 5/1977 | Zaki et al. |
| 4,128,484 | A | 12/1978 | Barford et al. |
| 4,234,627 | A | 11/1980 | Schilling |
| 4,483,779 | A | 11/1984 | Llenado et al. |
| 4,483,780 | A | 11/1984 | Llenado |
| 4,514,461 | A | 4/1985 | Woo |
| 4,540,721 | A | 9/1985 | Staller |
| 4,565,647 | A | 1/1986 | Llenado |
| RE32,713 | E | 7/1988 | Woo |
| 4,806,266 | A | 2/1989 | Burrill |
| 4,882,220 | A | 11/1989 | Ono et al. |
| 4,917,920 | A | 4/1990 | Ono et al. |
| 4,973,422 | A | 11/1990 | Schmidt |
| 5,188,769 | A | 2/1993 | Connor et al. |
| 5,332,528 | A | 7/1994 | Pan et al. |
| 5,525,588 | A | 6/1996 | Michetti |
| 5,648,329 | A | 7/1997 | Blake et al. |
| 5,670,476 | A | 9/1997 | Vogel et al. |
| 5,707,950 | A | 1/1998 | Kasturi et al. |
| 5,728,671 | A | 3/1998 | Rohrbaugh et al. |
| 6,020,303 | A | 2/2000 | Cripe et al. |
| 6,024,943 | A | 2/2000 | Ness et al. |
| 6,042,792 | A | 3/2000 | Shefer et al. |
| 6,051,540 | A | 4/2000 | Shefer et al. |
| 6,093,856 | A | 7/2000 | Cripe et al. |
| 6,100,233 | A | 8/2000 | Sivik et al. |
| 6,150,322 | A | 11/2000 | Singleton et al. |
| 6,153,577 | A | 11/2000 | Cripe et al. |
| 6,200,949 | B1 | 3/2001 | Reijmer et al. |
| 6,482,994 | B2 | 11/2002 | Scheper et al. |
| 6,531,444 | B1 | 3/2003 | Shefer et al. |
| 6,551,986 | B1 | 4/2003 | Littig et al. |
| 6,642,200 | B1 | 11/2003 | Zhang et al. |
| 6,645,479 | B1 | 11/2003 | Shefer et al. |
| 6,844,309 | B1 | 1/2005 | Sivik et al. |

(Continued)

FOREIGN PATENT DOCUMENTS

| | | | |
|---|---|---|---|
| CA | 2 735 761 | A1 | 1/2012 |
| EP | 0210731 | A2 | 2/1987 |

(Continued)

OTHER PUBLICATIONS

Kolb, B, Application of an automated head-space procedure for trace analysis by gas chromatography, Journal of Chromatography, Elsevier Science Publishers B.V, NL, Jan. 1, 1976, pp. 553-568, vol. 122.

(Continued)

*Primary Examiner* — Charles Boyer

(74) *Attorney, Agent, or Firm* — James F. McBride; Steven W. Miller

(57) ABSTRACT

Process to prepare an aqueous composition comprising a non-ionic antibacterial compound having a ClogP above about 2, the process having the steps of:

pre-mixing the non-ionic antibacterial compound having a ClogP above about 2 with an oil to prepare a premix having more than about 60% per weight of the premix of oil and of non-ionic antibacterial compound having a ClogP above about 2, mixing the premix with water to obtain an aqueous composition having more than about 50% per weight of water.

21 Claims, No Drawings

(56) References Cited

U.S. PATENT DOCUMENTS

| | | | | |
|---|---|---|---|---|
| 6,908,962 | B1 | 6/2005 | Frankenbach et al. | |
| 2002/0040504 | A1 | 4/2002 | DuVal et al. | |
| 2003/0060390 | A1 | 3/2003 | Demeyere et al. | |
| 2003/0125224 | A1 | 7/2003 | Seitz, Jr. et al. | |
| 2003/0158344 | A1 | 8/2003 | Rodriques et al. | |
| 2003/0165692 | A1 | 9/2003 | Koch et al. | |
| 2003/0195133 | A1 | 10/2003 | Shefer et al. | |
| 2003/0195263 | A1* | 10/2003 | Schmaus et al. | 514/738 |
| 2003/0203829 | A1 | 10/2003 | Shefer et al. | |
| 2003/0215417 | A1 | 11/2003 | Uchiyama et al. | |
| 2003/0216488 | A1 | 11/2003 | Uchiyama et al. | |
| 2004/0071742 | A1 | 4/2004 | Popplewell et al. | |
| 2004/0071746 | A1 | 4/2004 | Popplewell et al. | |
| 2004/0072719 | A1 | 4/2004 | Bennett et al. | |
| 2004/0072720 | A1 | 4/2004 | Brain et al. | |
| 2004/0087476 | A1 | 5/2004 | Dykstra et al. | |
| 2004/0087477 | A1 | 5/2004 | Ness | |
| 2004/0091445 | A1 | 5/2004 | Dykstra et al. | |
| 2004/0092414 | A1 | 5/2004 | Clapp et al. | |
| 2004/0106536 | A1 | 6/2004 | Mane et al. | |
| 2004/0110648 | A1 | 6/2004 | Jordan, IV et al. | |
| 2005/0064000 | A1* | 3/2005 | Kropke et al. | 424/401 |
| 2006/0252668 | A1 | 11/2006 | Frankenbach et al. | |
| 2007/0149424 | A1 | 6/2007 | Warr et al. | |
| 2007/0275866 | A1 | 11/2007 | Dykstra | |
| 2008/0031961 | A1 | 2/2008 | Cunningham et al. | |
| 2008/0242584 | A1 | 10/2008 | Wahl et al. | |
| 2009/0238787 | A1 | 9/2009 | Finke et al. | |
| 2010/0173816 | A1 | 7/2010 | Wichmann | |
| 2010/0298191 | A1* | 11/2010 | Denome et al. | 510/220 |
| 2010/0323938 | A1 | 12/2010 | Quellet et al. | |
| 2013/0090282 | A1 | 4/2013 | Blondel | |
| 2013/0156708 | A1* | 6/2013 | Pesaro et al. | 424/59 |
| 2013/0203642 | A1 | 8/2013 | Huchel et al. | |
| 2014/0075685 | A1 | 3/2014 | Saveyn et al. | |
| 2014/0075686 | A1 | 3/2014 | Saveyn et al. | |
| 2014/0080749 | A1 | 3/2014 | Ravidat et al. | |
| 2014/0080750 | A1 | 3/2014 | Demeyere et al. | |
| 2014/0080917 | A1 | 3/2014 | Demeyere et al. | |

FOREIGN PATENT DOCUMENTS

| | | | |
|---|---|---|---|
| EP | 1393706 | A1 | 3/2004 |
| WO | WO 92/06162 | A1 | 4/1992 |
| WO | WO 93/19146 | A1 | 9/1993 |
| WO | WO 96/06152 | A2 | 2/1996 |
| WO | WO 00/32735 | A1 | 6/2000 |

OTHER PUBLICATIONS

Berglund, L.G. et al., Simulation of the Thermal Effects of Dissolved Materials in Human Sweat, Computers and Biomedical Research, Academic Press, London, GB, Jan. 1, 1973, pp. 127-138, vol. 6.

Normand, V. et al., Modelling perfume deposition on fabric during a washing cycle: theoretical approach, Flavour and Fragrance Journal, 2008, pp. 49-57, vol. 23.

Liu, H. et al., Adsorption of Aroma Chemicals on Cotton Fabric from Aqueous Systems, Journal of Surfactants and Detergents, 2005, pp. 311-317, vol. 8, No. 4.

Ignac, Capek, Degradation of kinetically-stable o/w emulsions, Advances in Colloid and Interface Science, 2004, pp. 125-155, vol. 107.

Extended European Search Report; Application No. 13176784.0-1358; dated Dec. 13, 2013; 7 pages.

International Search Report; International Application No. PCT/US2013/059568; date of mailing Dec. 11, 2013; 5 pages.

International Search Report; International Application No. PCT/US2013/058912; date of mailing Dec. 12, 2013; 5 pages.

International Search Report; International Application No. PCT/US2013/058924; date of mailing Dec. 13, 2013; 4 pages.

International Search Report; International Application No. PCT/US2013/058935; date of mailing Dec. 16, 2013; 5 pages.

* cited by examiner

PROCESS TO INTRODUCE HYDROPHOBIC ANTIBACTERIAL COMPOUND IN AN AQUEOUS COMPOSITION

FIELD OF THE INVENTION

The present invention relates to a process to introduce a non-ionic antibacterial compound having a ClogP above 2 in an aqueous composition to fight malodour, for example an aqueous fabric-care composition.

BACKGROUND OF THE INVENTION

Antibacterial compound can be effective in the fight against malodour. This is due to the ability of the antibacterial compound to limit the growth, or to kill, or to limit the activity of bacteria generating malodour.

The inventors have discovered that a process to incorporate a specific antibacterial compound in an aqueous composition is particularly effective to boost the malodour fighting properties of the aqueous composition.

SUMMARY OF THE INVENTION

According to the present invention, there is provided a process to prepare an aqueous composition comprising a non-ionic antibacterial compound having a ClogP above 2, comprising the steps of:

pre-mixing the non-ionic antibacterial compound having a ClogP above 2 with an oil to prepare a premix comprising more than 60% per weight of the premix of oil and of non-ionic antibacterial compound having a ClogP above 2, mixing the premix with water to obtain an aqueous composition comprising more than 50% per weight of water.

The inventors have discovered that the aqueous composition obtained with the process of the invention were particularly effective to fight malodour.

The aqueous composition may be an aqueous fabric-care composition, preferably a rinsing composition, comprising:

a. from 0 wt % to 5 wt % of anionic surfactant, b. from 0 wt % to 3 wt % of cationic surfactant, c. from 0 wt % to 3 wt % of a non-ionic surfactant, d. from 0.01 wt % to 15 wt % of perfume, e. from 0.01 wt % to 15 wt % of a non-ionic antibacterial compound having a ClogP above 2, f. from 50 wt % to 99.98 wt % of water.

The malodour benefit obtained with the process of the invention is particularly effective when the composition comprises a low level of surfactant.

The aqueous composition may be a fabric-care composition and/or may comprise from 0 wt % to 1.5 wt % of anionic surfactant, from 0 wt % to 1.5 wt % of cationic surfactant, from 0 wt % to 2 wt % of a non-ionic surfactant, from 0.02 wt % to 5 wt % of perfume, from 0.02 wt % to 5 wt % of a non-ionic antibacterial compound having a ClogP above 2, and from 50 wt % to 99 wt % of water.

DETAILED DESCRIPTION OF THE INVENTION

All percentages, ratios and proportions used herein are by weight percent of the composition, unless otherwise specified. All average values are calculated "by weight" of the composition or components thereof, unless otherwise expressly indicated.

The Process

The process of the invention is to prepare an aqueous composition comprising a non-ionic antibacterial compound having a ClogP above 2.

The process comprises a first step comprising the pre-mixing a non-ionic antibacterial compound having a ClogP above 2 with an oil to form a premix. The pre-mixing step may happen at room temperature or at a temperature between 10° C. and 50° C. The premixing step may last for at least 5 seconds, or at least 10 seconds, or at least 30 seconds, or at least 1 minute, or at least 5 minutes.

The process comprises a second step comprising the mixing of the premix with water to form the aqueous composition. The mixing step may happen at room temperature or at a temperature between 10° C. and 50° C.

The Premix

The premix comprises a non-ionic antibacterial compound having a ClogP above 2. The premix may comprise from 0.2% to 50%, or from 0.5% to 20%, or from 1% to 10%, or from 2% to 5%, per weight of non-ionic antibacterial compound having a ClogP above 2.

The premix comprises oil. The premix may comprise more than 30% or even more than 50%, for example from 70% to 100%, or from 80% to 99%, or from 90% to 98% of oil.

The oil and the non-ionic antibacterial compound may be mixed during at least 5 seconds or during at least 10 s, or at least 30 s, or at least 1 minute, or at least 5 minutes, to form the premix.

In the premix, the weight ratio of oil to non-ionic antibacterial compound having a ClogP above 2 may be between 5 and 200, or between 10 and 100, or between 20 and 50.

Optionally the premix can further comprise a non-ionic surfactant. The premix may comprise from 0.4% to 50%, or from 1% to 30%, or from 2% to 20%, or from 4% to 10%, per weight of non-ionic surfactant.

In the premix, the weight ratio of non-ionic surfactant to oil may be between 0 and 10, or between 0.03 and 3, or between 0.1 and 1.

In the premix, the weight ratio of non-ionic surfactant to non-ionic antibacterial compound having a ClogP above 2 may be between 0 and 20, or between 0.5 and 5, or between 1 and 3.

The premix preferably comprises no water or at least less than 40% or less than 30%, or even less than 20%, or less than 10%, for example less than 5%, or less than 3% or between 0 and 1.5% by weight of water.

The premix preferably comprises no cationic surfactant or from 0% to 10%, or less than 5%, or even less than 2%, or less than 1%, or less than 0.5%, by weight of cationic surfactant.

The premix preferably comprises no anionic surfactant or from 0% to 10%, or less than 5%, or even less than 2%, or less than 1%, or less than 0.5%, by weight of anionic surfactant.

The premix typically comprise no suds suppressor technology or from 0% to 10%, or less than 5%, or even less than 2%, or less than 1% by weight of suds suppressor technology.

The premix typically comprise no polymeric thickener or from 0% to 10%, or less than 5%, or even less than 2%, or less than 1% by weight of polymeric thickener.

The premix has typically a Brookfield viscosity at 60 rpm at 21° C. of between 10 cp and 120 cp, for example between 15 cp and 80 cp or between 20 cp and 50 cp.

The viscosity may be measured with of a Brookfield viscometer DV-H.

The Aqueous Composition

The aqueous composition is obtained by mixing the premix with water and optional additional ingredients. The aqueous composition comprises the ingredients of the premix.

The aqueous composition may comprise from 0.2% to 20% or from 0.5% to 10% or from 1% to 5% by weight of the premix.

The aqueous composition is preferably in liquid form. The composition may be a rinse-added composition.

The aqueous composition may be comprised in a package. The package preferably does not comprise a spraying system.

The aqueous composition may be comprised in a package comprising from 1 ml to 3 l of product, for example from 2 ml to 1 l or from 3 ml to 500 ml or from 5 ml to 100 ml or from 7 ml to 50 ml or from 10 ml to 20 ml.

The package may be a bottle or a sachet. The package may comprise plastic such as polyolefins, polyesters, polyamides, vinyl, polyvinylchloride, acrylic, polycarbonates, polystyrene, and polyurethane. Plastics can include both thermoplastic and/or thermoset. The plastic bottle may comprise PET and/or may comprise from 100 ml to 1.5 l of product, preferably from 300 ml to 1 l. The sachet may comprise from 5 ml to 30 ml of product, preferably from 10 ml to 20 ml.

The aqueous composition comprises a non-ionic antibacterial compound having a ClogP above 2. The aqueous composition may comprise from 0.01% to 5%, or from 0.02% to 2%, or from 0.05% to 1%, or from 0.1 to 2%, per weight of non-ionic antibacterial compound having a ClogP above 2.

The aqueous composition comprises oil. The aqueous composition may comprise more than 0.1%, or even more than 0.2%, for example from 0.5% to 10%, or from 1% to 5%, or from 2% to 4% of oil, in particular of perfume oil.

The aqueous composition comprises at least 50% per weight of water, for example from 60% to 99.9%, or from 70% to 99.5%, or from 80% to 99%, or from 90% to 98%, by weight of water.

It is preferable that the aqueous composition does not comprise or comprises a limited amount of surfactant. The aqueous composition may comprise from 0% to 5% by weight of surfactant. Preferably the aqueous composition comprises less than 3%, or even less than 1%, or even less than 0.5%, or 0.2%, or 0.1% by weight of surfactant. When a surfactant is present, it is preferred that the surfactant is a non-ionic surfactant.

Optionally, the aqueous composition can comprise a non-ionic surfactant. The aqueous composition may comprise from 0% to 5%, or from 0.01% to 3%, or from 0.02% to 2%, or from 0.05% to 1%, per weight of non-ionic surfactant.

The aqueous composition preferably comprises no cationic surfactant, or from 0% to 10%, or less than 5%, or even less than 2%, or less than 1% by weight of cationic surfactant.

The aqueous composition preferably comprises no anionic surfactant or from 0% to 10%, or less than 5%, or even less than 2%, or less than 1% by weight of anionic surfactant.

The aqueous composition may comprise a suds suppressor technology, for example from 0.01% to 10%, or from 0.02% to 5%, or from 0.05% to 2%, or from 0.1% to 1% by weight of suds suppressor technology.

The aqueous composition may comprise a polymeric thickener, for example from 0.01% to 10%, or from 0.02% to 5%, or from 0.05% to 2%, or from 0.1% to 1% by weight of polymeric thickener.

The aqueous composition has typically a Brookfield viscosity at 60 rpm at 21° C. of higher than 20 cp or 30 cp, for example between 40 cp and 1000 cp or between 80 cp and 500 cp.

The viscosity may be measured with of a Brookfield viscometer DV-H.

The aqueous composition may comprise perfume microcapsule. The character of the perfume in the perfume microcapsules is particularly stable during storage of the aqueous composition. The aqueous composition preferably comprises at least 0.05%, preferably at least 0.15% or at least 0.25% or even at least 0.5% by weight of perfume micro-capsules. Typically, the aqueous composition comprises from 0.1% to 10%, or from 0.2% to 5% or from 0.3% to 2% by weight of perfume micro-capsules.

The aqueous composition may comprise adjunct ingredients. The ingredients may include dispersing agent, stabilizer, pH control agent, metal ion control agent, colorant, brightener, dye, odor control agent, pro-perfume, cyclodextrin, solvent, soil release polymer, preservative, chlorine scavenger, enzyme, antishrinkage agent, fabric crisping agent, spotting agent, anti-oxidant, anti-corrosion agent, bodying agent, drape and form control agent, smoothness agent, static control agent, wrinkle control agent, sanitization agent, disinfecting agent, germ control agent, mold control agent, mildew control agent, antiviral agent, drying agent, stain resistance agent, soil release agent, malodor control agent, fabric refreshing agent, chlorine bleach odor control agent, dye fixative, dye transfer inhibitor, color maintenance agent, color restoration/rejuvenation agent, anti-fading agent, whiteness enhancer, anti-abrasion agent, wear resistance agent, fabric integrity agent, anti-wear agent, rinse aid, UV protection agent, sun fade inhibitor, insect repellent, anti-allergenic agent, flame retardant, water proofing agent, fabric comfort agent, water conditioning agent, stretch resistance agent, cationic starch, and combinations thereof. Each adjunct ingredient may be present in an amount of for example from 0.01 to 3% by weight of the composition. The composition may be free or essentially free of some or all of the above mentioned adjunct ingredient.

The aqueous composition may have a pH of from 2 to 5, preferably from 2 to 4.5, and more preferably from 2.5 to 4. In another embodiment, the composition may have a pH from 5 to 9, alternatively from 5.1 to 6, alternatively from 6 to 8, alternatively of about 7.

The Ingredients of the Premix and/or of the Aqueous Composition

The Oil

Typically, the oil comprises a perfume oil.

Preferably, the perfume oil comprises a mixture of at least 3, or even at least 5, or at least 7, or at least 10, or at least 15 perfume oils.

Preferably, the oil comprises at least 25% per weight, in particular at least 35%, or at least 50%, or at least 70%, or at least 90%, for example from 65% to 100%, or from 95% to 99.9% per weight of oils, in particular perfume oils, having a CLogP between 2.5 and 6 or between 3 and 5.5 or between 3.5 and 4.5, or above 4.

The Antibacterial Compound

The aqueous composition and the premix comprise a non-ionic antibacterial compound having a ClogP above 2. Preferably, the premix and the aqueous composition comprise a non-ionic antibacterial compound having a ClogP above 3 or above 4.

ClogP refers to the octanol/water partitioning coefficient (P) of a compound such as oils, perfume oils, or antibacterial compounds. The octanol/water partitioning coefficient of a compound is the ratio between its equilibrium concentrations in octanol and in water. The partitioning coefficients of the compounds are more conveniently given in the form of their logarithm to the base 10, logP. The logP of many compounds has been reported; for example, the Pomona92 database, available from Daylight Chemical Information Systems, Inc. (Daylight CIS), Irvine, Calif., contains many, along with citations to the original literature. The ClogP values reported herein are most conveniently calculated by the "CLOGP"

program available within the Chemoffice Ultra Software version 9 available from CambridgeSoft Corporation, 100 CambridgePark Drive, Cambridge, Mass. 02140 USA or CambridgeSoft Corporation, 8 Signet Court, Swanns Road, Cambridge CB5 8LA UK. The ClogP values are preferably used instead of the experimental logP values in the selection of oils, perfume oils, or antibacterial compound which are useful in the present invention.

The non-ionic antibacterial compound having a ClogP above 2 may be selected from anilides antibacterial compounds, such as triclocarban; biguanides antibacterial compounds, such as chlorhexidine; phenolics antibacterial compounds, such as p-chloro-m-xylenol, butylated hydroxyl toluene, or butylated hydroxyl anisole; triclosan; diclosan; or mixtures thereof. A preferred antibacterial compound is Diclosan.

Triclocarban has a ClogP of 4.93 and is known under the name Preventol SB and can be supplied Lanxess.

Chlorhexidine is sold under the name Hibiclens by Mölnlycke Health Care AB and has a ClogP value of 4.51.

P-chloro-m-xylenol (PCMX) is sold by Netchem Inc Canada and has a ClogP of 3.377.

Butylated hydroxyl toluene or BHT-Ionol CP is available from Ashland Chemical Co and has a ClogP value of 5.27.

Butylated hydroxyl anisole or BHA is available from Ashland Chemical Co and has a ClogP value of 3.06.

Triclosan is sold by BASF and has a ClogP of 4.98.

Diclosan is sold under the trademark name Tinosan®HP100, supplied by BASF and has a ClogP of 4.38.

Preferably, the antibacterial compound is not a perfume. This allows better flexibility to the perfumers who are not bound to the smell of the antibacterial compound to design their perfume around.

In particular the odour detection threshold of the antibacterial compound may be above 100, or even 1000, or even 10.000 or 100.000 or 1.000.000, or even 10.000.000 part per billion (1.000.000.000). The odour detection threshold is defined as the lowest vapour concentration of that material which can be olfactorily detected. The odour detection threshold and some odour detection values are discussed in discussed in eg "Standardized Human Olfactory Thresholds", M. Devos et al, IRL Press at Oxford University Press, 1990, and "Compilation of Odor and Taste Threshold Values Data", F. A. Fazzalar, editor ASTM Data Series DS 48A, American Society for Testing and Materials, 1978.

The antibacterial compound may have a boiling point above 300° C. or even above 450° C. or above 600° C. or even above 700° C.

The weight ratio of non-ionic antibacterial compound having a ClogP above 2 to the total amount of antibacterial compound in the premix and/or in the aqueous composition of the invention is preferably above 0.5 preferably above 0.6 or 0.75, for example between 0.9 and 1.

The Surfactant System

The anionic surfactant may comprise alkyl benzene sulfonic acids and their salts, alkoxylated or non-alkoxylated alkyl sulfate materials, ethoxylated alkyl sulfate surfactants, mid-branched primary alkyl sulfate surfactants, and mixtures thereof.

The cationic surfactants may include but are not limited to, quaternary ammonium compounds. Quaternary ammonium compounds may comprise ester quats, amide quats, imidazoline quats, alkyl quats, amdioester quats, and mixtures thereof.

Non-ionic surfactants include alkoxylated fatty alcohols, amine oxide surfactants, sorbitan esters and their derivatives, and mixtures thereof.

In the aqueous composition and/or in the premix, the weight ratio of (cationic surfactant+anionic surfactant+non-ionic surfactant) to (non-ionic surfactant) is preferably below 10, preferably below 5, for example between 1 and 2, or between 1 and 1.5. or between 1 and 1.2 or between 1 and 1.1.

Zwitterionic surfactants and amphoteric surfactants which are substantially non-ionic at neutral pH may be considered as non-ionic surfactants for the purpose of the invention. Zwitterionic surfactants and amphoteric surfactants which are substantially cationic or anionic at neutral pH may respectively be considered as cationic or anionic surfactants for the purpose of the invention.

The aqueous composition and/or the premix may comprise no zwitterionic and/or amphoteric surfactant or a limited amount of such surfactant. The aqueous composition may comprise from 0% to 3% by weight of zwitterionic and/or amphoteric surfactant or less than 2%, or even less than 1% or even less than 0.5%, or 0.2%, or 0.1% by weight of zwitterionic and/or amphoteric surfactant.

Polymeric Thickener

Suitable polymeric thickeners are disclosed in, for example, U.S. patent application Ser. No. 12/080,358.

The polymeric thickener may be a cationic or amphoteric polymer. The polymeric thickener may be a cationic polymer. The polymeric thickener may be a cationic polyacrylate. The cationic polymer may comprise a cationic acrylate such as Rheovis CDE™. The cationic polymer may have a cationic charge density of from 0.005 to 23, from 0.01 to 12, or from 0.1 to 7 milliequivalents/g, at the pH of intended use of the aqueous composition. For amine-containing polymers, wherein the charge density depends on the pH of the composition, charge density is measured at the intended use pH of the product. Such pH will generally range from 2 to 11, more generally from 2.5 to 9.5. Charge density is calculated by dividing the number of net charges per repeating unit by the molecular weight of the repeating unit. The positive charges may be located on the backbone of the polymers and/or the side chains of polymers.

One group of suitable cationic polymers includes those produced by polymerization of ethylenically unsaturated monomers using a suitable initiator or catalyst, such as those disclosed in U.S. Pat. No. 6,642,200.

Suitable polymers may be selected from the group consisting of cationic or amphoteric polysaccharide, polyethylene imine and its derivatives, and a synthetic polymer made by polymerizing one or more cationic monomers selected from the group consisting of N,N-dialkylaminoalkyl acrylate, N,N-dialkylaminoalkyl methacrylate, N,N-dialkylaminoalkyl acrylamide, N,N-dialkylaminoalkylmethacrylamide, quaternized N,N dialkylaminoalkyl acrylate quaternized N,N-dialkylaminoalkyl methacrylate, quaternized N,N-dialkylaminoalkyl acrylamide, quaternized N,N-dialkylaminoalkylmethacrylamide, Methacryloamidopropyl-pentamethyl-1,3-propylene-2-ol-ammonium dichloride, N,N,N,N',N',N",N"-heptamethyl-N"-3-(1-oxo-2-methyl-2-propenyl) aminopropyl-9-oxo-8-azo-decane-1,4,10-triammonium trichloride, vinylamine and its derivatives, allylamine and its derivatives, vinyl imidazole, quaternized vinyl imidazole and diallyl dialkyl ammonium chloride and combinations thereof, and optionally a second monomer selected from the group consisting of acrylamide, N,N-dialkyl acrylamide, methacrylamide, N,N-dialkylmethacrylamide, $C_1$-$C_{12}$ alkyl acrylate, $C_1$-$C_{12}$ hydroxyalkyl acrylate, polyalkylene glyol acrylate, $C_1$-$C_{12}$ alkyl methacrylate, $C_1$-$C_{12}$ hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole, vinyl caprolactam, and derivatives, acrylic acid, methacrylic acid, maleic acid, vinyl sulfonic acid, styrene sulfonic acid, acrylamidopropylmethane sulfonic acid (AMPS) and their salts. The polymer may optionally be branched or cross-linked by using branching and crosslinking monomers. Branching and crosslinking monomers include ethylene glycoldiacrylate divinylbenzene, and butadiene. A suitable polyethyleneinine useful herein is that sold under the tradename Lupasol® by BASF, AG, Lugwigschaefen, Germany The thickener may comprise an amphoteric polymeric thickener polymer. The polymer preferably possesses a net positive charge. Said polymer may have a cationic charge density of 0.05 to 18 milliequivalents/g.

The polymeric thickener may be selected from the group consisting of cationic polysaccharide, polyethylene imine and its derivatives, poly(acrylamide-co-diallyldimethylammonium chloride), poly(acrylamide-methacrylamidopropyltrimethyl ammonium chloride), poly(acrylamide-co-N,N-dimethyl aminoethyl acrylate) and its quaternized derivatives, poly(acrylamide-co-N,N-dimethyl aminoethyl methacrylate) and its quaternized derivative, poly(hydroxyethylacrylate-co-dimethyl aminoethyl methacrylate), poly (hydroxpropylacrylate-co-dimethyl aminoethyl methacrylate), poly(hydroxpropylacrylate-co-methacrylamidopropyltrimethylammonium chloride), poly (acrylamide-co-diallyldimethylammonium chloride-co-acrylic acid), poly(acrylamide-methacrylamidopropyltrimethyl ammonium chloride-co-acrylic acid), poly(diallyldimethyl ammonium chloride), poly(vinylpyrrolidone-co-dimethylaminoethyl methacrylate), poly(ethyl methacrylate-co-quaternized dimethylaminoethyl methacrylate), poly(ethyl methacrylate-co-oleyl methacrylate-co-diethylaminoethyl methacrylate), poly(diallyldimethylammonium chloride-co-acrylic acid), poly(vinyl pyrrolidone-co-quaternized vinyl imidazole) and poly (acrylamide-co-Methacryloamidopropyl-pentamethyl-1,3-propylene-2-ol-ammonium dichloride), Suitable polymeric thickeners include Polyquaternium-1, Polyquaternium-5, Polyquaternium-6, Polyquaternium-7, Polyquaternium-8, Polyquaternium-11, Polyquaternium-14, Polyquaternium-22, Polyquaternium-28, Polyquaternium-30, Polyquaternium-32 and Polyquaternium-33, as named under the International Nomenclature for Cosmetic Ingredients.

The polymeric thickener may comprise polyethyleneimine or a polyethyleneimine derivative. The polymeric thickener may comprise a cationic acrylic based polymer. The polymeric thickener may comprise a cationic polyacrylamide. The polymeric thickener may comprise a polymer comprising polyacrylamide and polymethacrylamidoproply trimethylammonium cation. The polymeric thickener may comprise poly(acrylamide-N-dimethyl aminoethyl acrylate) and its quaternized derivatives. The polymeric thickener may be that sold under the tradename Sedipur®, available from BTC Specialty Chemicals, a BASF Group, Florham Park, N.J. The polymeric thickener may comprise poly(acrylamide-co-methacrylamidopropyltrimethyl ammonium chloride). The polymeric thickener may comprise a non-acrylamide based polymer, such as that sold under the tradename Rheovis® CDE, available from Ciba Specialty Chemicals, a BASF group, Florham Park, N.J., or as disclosed in USPA 2006/0252668.

The polymeric thickener may be selected from the group consisting of cationic or amphoteric polysaccharides. The polymeric thickener may be selected from the group consisting of cationic and amphoteric cellulose ethers, cationic or amphoteric galactomanan, cationic guar gum, cationic or amphoteric starch, and combinations thereof.

The polymeric thickener may be selected from cationic polymers such as alkylamine-epichlorohydrin polymers which are reaction products of amines and oligoamines with epicholorohydrin, for example, those polymers listed in, for example, U.S. Pat. Nos. 6,642,200 and 6,551,986. Examples include dimethylamine-epichlorohydrin-ethylenediamine, available under the trade name Cartafix® CB and Cartafix® TSF from Clariant, Basle, Switzerland.

The polymeric thickener may be selected from cationic polymers such as polyamidoamine-epichlorohydrin (PAE) resins of polyalkylenepolyamine with polycarboxylic acid. The most common PAE resins are the condensation products of diethylenetriamine with adipic acid followed by a subsequent reaction with epichlorohydrin. They are available from Hercules Inc. of Wilmington Del. under the trade name Kymene™ or from BASF AG (Ludwigshafen, Germany) under the trade name Luresin™.

The cationic polymers may contain charge neutralizing anions such that the overall polymer is neutral under ambient conditions. Non-limiting examples of suitable counter ions (in addition to anionic species generated during use) include chloride, bromide, sulfate, methylsulfate, sulfonate, methylsulfonate, carbonate, bicarbonate, formate, acetate, citrate, nitrate, and mixtures thereof.

The cationic polymeric thickener may be obtained by polymerisation of a cationic monomer and a monomer with hydrophobic nature and a non-ionic monomer. In particular, the cationic polymeric thickener may be as disclosed in WO2011/148110. The cationic polymeric thickener may be supplied by SNF.

The weight-average molecular weight of the polymer may be from 500 to 5,000,000, or from 1,000 to 2,000,000, or from 2,500 to 1,500,000 Daltons, as determined by size exclusion chromatography relative to polyethyleneoxide standards with RI detection. In one aspect, the MW of the cationic polymer may be from about 500 to about 37,500 Daltons.

Preferably the weight ratio of surfactant to polymeric thickener is below 30, preferably below 10 preferably below 5. For example the weight ratio of surfactant to polymeric thickener is between 0.8 and 20.

Perfume Micro-Capsule

Perfume micro-capsules typically comprise a core comprising a perfume, a shell having an inner and outer surface, said shell encapsulating said core. The perfume micro-capsules may comprise at least 30%, or at least 50%, for example at least 70% or 90% by weight of the perfume microcapsule of perfume. The shell may comprise a material selected from the group consisting of polyethylenes; polyamides; polystyrenes; polyisoprenes; polycarbonates; polyesters; polyacrylates; aminoplasts, in one aspect said aminoplast may comprise a polyureas, polyurethane, and/or polyureaurethane, in one aspect said polyurea may comprise polyoxymethyleneurea and/or melamine formaldehyde; polyolefins; polysaccharides, in one aspect said polysaccharide may comprise alginate and/or chitosan; gelatin; shellac; epoxy resins; vinyl polymers; water insoluble inorganics; silicone; and mixtures thereof. Preferably the perfume micro-capsules comprise an aminoplast material, polyamide material and/or an acrylate material, for example a melamine-formaldehyde and/or cross linked melamine formaldehyde or ureaformaldehyde material. Suitable amines include melamine, urea, benzoguanamine, glycoluril, and mixtures thereof. Suitable melamines include, methylol melamine, methylated methylol melamine, imino melamine and mixtures thereof. Suitable ureas include, dimethylol urea, methylated dimethylol urea, urea-resorcinol, and mixtures thereof.

The perfume microcapsule may comprise a cationic, non-ionic and/or anionic deposition aid. The perfume microcapsule may comprise a deposition aid selected from the group consisting of, a cationic polymer, a non-ionic polymer, an anionic polymer and mixtures thereof. The perfume microcapsule may comprise a cationic polymer. The perfume microcapsule may comprise a moisture-activated microcapsule (e.g., cyclodextrin comprising perfume microcapsule).

The perfume micro-capsule may have a particle size of from 1 micron to 80 microns, 5 microns to 60 microns, from 10 microns to 50 microns, or even from 15 microns to 40 microns. The perfume micro-capsule may have a particle wall thickness of from 30 nm to 250 nm, from 80 nm to 180 nm, or even from 100 nm to 160 nm.

Encapsulation techniques can be found in "Microencapsulation: methods and industrial applications" edited by Benita and Simon (marcel Dekker Inc 1996).

Suitable perfume microcapsules include those described in the following references: US 2003215417 A1; US 2003216488 A1; US 2003158344 A1; US 2003165692 A1; US 2004071742 A1; US 2004071746 A1; US 2004072719 A1; US 2004072720 A1; EP 1393706 A1; US 2003203829 A1; US 2003195133 A1; US 2004087477 A1; US 20040106536 A1; U.S. Pat. Nos. 6,645,479; 6,200,949; 4,882,220; 4,917,920; 4,514,461; U.S. RE 32713; U.S. Pat. No. 4,234,627.

The Perfume micro-capsule comprises a perfume. Preferably, the perfume comprises a mixture of at least 3, or even at least 5, or at least 7 perfume raw material. The perfume may comprise at least 10 or at least 15 perfume raw materials.

The inventors have discovered that the compositions of the invention could be particularly effective at lowering the character changes of a perfume when the perfume comprises perfume raw material having different ClogP value. Indeed, when the composition comprises a high level of surfactant, in particular anionic or cationic surfactant, the character of the perfume may drastically change over time if the perfume raw materials have ClogP that extend on a broad range of values. Lowering the level of surfactant, as taught by the current invention, is thus particularly desirable with that kind of perfume.

The perfume micro-capsule may comprise between 10% and 50% or between 15% and 40% or at between 20% and 30% of perfume raw materials having a ClogP comprised between 1.5 and 2.5 and comprise between 10% and 50% or between 15% and 40% or at between 20% and 30% of perfume raw materials having a ClogP comprised between 3.5 and 4.5.

The perfume micro-capsule may comprise between 10% and 50% or between 15% and 40% or at between 20% and 30% of perfume raw materials having a ClogP comprised between 2 and 3 and comprise between 10% and 50% or between 15% and 40% or at between 20% and 30% of perfume raw materials having a ClogP comprised between 4 and 5.

The perfume micro-capsule may comprise between 10% and 50% or between 15% and 40% or at between 20% and 30% of perfume raw materials having a ClogP comprised between 2.5 and 3.5 and comprise between 10% and 50% or between 15% and 40% or at between 20% and 30% of perfume raw materials having a ClogP comprised between 4.5 and 5.5.

To further minimize the perfume character change, it is also possible to choose a perfume comprising perfume raw materials having similar ClogP value, in particular similar high ClogP value. In that case, the combination of the low level of surfactant and the choice of perfume raw materials having similar ClogP leads to the lowest changes in perfume character overtime.

The perfume micro-capsule may comprises at least 30% or at least 50% or at least 70% or at least 80%, or at least 90% by weight of perfume raw materials having a ClogP comprised between 2 and 5.

The perfume micro-capsule may comprises at least 30% or at least 50% or at least 70% or at least 80%, or at least 90% by weight of perfume raw materials having a ClogP comprised between 2.5 and 4.5.

The perfume micro-capsule may comprises at least 30% or at least 50% or at least 70% or at least 80%, or at least 90% by weight of perfume raw materials having a ClogP comprised between 3 and 4.

The perfume micro-capsule may comprises at least 30% or at least 50% or at least 70% or at least 80%, or at least 90% by weight of perfume raw materials having a ClogP comprised between 4 and 5.

The Suds Suppressor Technology

The suds suppressor technology may comprise any known antifoam compound, including highly crystalline waxes and/or hydrogenated fatty acids, silicones, silicone/silica mixtures, lower 2-alkyl alkanols, fatty acids, and mixtures thereof.

The lower 2-alkyl alkanol may be 2-methyl-butanol.

The fatty acid may be a $C_{12}$-$C_{18}$ saturated and/or unsaturated, linear and/or branched, fatty acid, and is preferably a mixture of such fatty acids. A preferred mixture of fatty acids is a mixtures of saturated and unsaturated fatty acids, for example a mixture of rape seed-derived fatty acid and $C_{16}$-$C_{18}$ topped whole cut fatty acids, or a mixture of rape seed-derived fatty acid and a tallow alcohol derived fatty acid, palmitic, oleic, fatty alkylsuccinic acids, and mixtures thereof. The fatty acids may be branched and of synthetic or natural origin, especially biodegradable branched types. Monocarboxylic fatty acids and soluble salts thereof, are described in U.S. Pat. No. 2,954,347.

Examples of silicones, and silica-silicone mixtures are disclosed in U.S. Pat. Nos. 5,707,950 and 5,728,671.

Examples of mixture of antifoam compounds are commercially available from companies such as Dow Corning.

Preferably, the suds suppressor technology comprises a silicone-based compound. Silicone based suds suppressor technology is described in (US 2003/0060390 A1, 65-77). Preferably, the composition comprises from 0.01 to 3% of a silicone-based compound. Less than 3% of a silicone based compound is typically enough to provide the desired rinsing properties. Preferably, the silicone based compound comprises polydimethylsiloxane. The silicone based antifoam compounds may comprise silica and siloxane, for example a polydimethylsiloxane having trimethylsilyl end blocking units. Examples of particulate suds suppressor technologies are described in EP-A-0210731. Examples of particulate suds suppressor technologies in particulate form are described in EP-A-0210721. The inventors have discovered that the suds suppressor technology comprising a silicone-based compound were particularly suitable in the aqueous fabric care composition of the invention.

EXAMPLES

Example 1

Preparation of Aqueous Fabric Care Compositions Eight Compositions are Prepared

| Ingredient | Ex 1A | Ex 1B* | Ex 1C* | Ex 1D* |
|---|---|---|---|---|
| Thickener (Flosoft ® 222) | 0.16 | 0.16 | 0.16 | 0.16 |
| Silicone Antifoam (PDMS) | 0.30 | 0.30 | 0.30 | 0.30 |
| Non ionic surfactant (Genapol T680 ®) | 0.75 | 0.75 | 0.75 | 0.75 |
| Non-ionic Antibacterial compound having a ClogP above 2 (Tinosan ® HP100) | 0.06 | 0.06 | 0.06 | 0 |
| BenzylBenzoate (oil having a ClogP of 3.7) | 2 | 2 | 2 | 2 |
| Non ionic surfactant (Tween 20 ®) | 0.1 | 0.1 | 0.1 | 0.1 |
| Demineralised Water and minors (dye, pH regulator, preservatives, . . . ) | balance | balance | balance | balance |

*Comparative Example

Composition 1A is prepared by pre-mixing the antibacterial compound, the oil and the Tween 20®. The pre-mix, the water, and all the other components are then mixed in water at room temperature with a Ytron-Y at 35 Hz during 15 minutes.

Composition 1B is prepared by pre-mixing the oil and the Tween 20®. The pre-mix, the water, the antibacterial compound, and all the other components are then mixed in water at room temperature with a Ytron-Y at 35 Hz during 15 minutes. The premix is added to the water before the antibacterial compound.

Composition 1C is prepared by pre-mixing the oil and the Tween 20®. The pre-mix, the water, the antibacterial compound and all the other components are then mixed in water at room temperature with a Ytron-Y at 35 Hz during 15 minutes. The antibacterial compound is added to the water before the premix.

Composition 1D is prepared by pre-mixing, the oil and the Tween 20®. The pre-mix, the water, and all the other components are then mixed in water at room temperature with a Ytron-Y at 35 Hz during 15 minutes.

| Ingredient | Ex 1E | Ex 1F | Ex 1G | Ex 1H |
|---|---|---|---|---|
| Thickener (Flosoft ® 222) | 0.16 | 0.1 | 0.2 | 0.15 |
| Perfume microcapsules | | | 1 | 2 |
| Silicone Antifoam (PDMS) | 0.30 | 0.6 | 0.2 | 0.1 |
| Non ionic surfactant (Genapol T680 ®) | 0.75 | | 0.9 | 0.3 |
| Non-ionic Antibacterial compound having a ClogP above 2 (Tinosan ® HP100) | 0.06 | 0.16 | 0.1 | 0.03 |

-continued

| Ingredient | Ex 1E | Ex 1F | Ex 1G | Ex 1H |
|---|---|---|---|---|
| Perfume oils | 2 | 1 | 3 | 2.5 |
| Non ionic surfactant (Tween 20 ®) | 0.1 | 0.05 | 0.2 | 0.15 |
| Demineralised Water and minors (dye, pH regulator, preservatives, . . . ) | balance | balance | balance | balance |

Composition 1E-1H prepared by pre-mixing the antibacterial compound, the perfume oils (eucalyptol, linalool, tetrahydro-linalool, alpha-ionone, gamma methyl ionone), and the Tween 20 ®. The pre-mix, the water, and all the other components are then mixed in water at room temperature with a Ytron-Y at 35 Hz during 15 minutes.

Example 2

Testing the Malodour of Wet Fabrics Rinsed with Compositions 1A-1D 12 batches of about 35 g of fabrics, comprising clean fabrics and soiled fabrics, are washed with water and then rinsed with a rinsing liquor comprising 600 g of water and 0.8 g of respectively compositions 1A, 1B, 1C, or 1D (3 replicates per rinsing compositions).

Each batch of fabric is left, wet, in a closed vessel for 24 hours.

The vessels are then opened and a group of panelists assesses the malodour strength from each vessel on a scale of 0 to 10. An average is calculated for each rinsing composition and the result is shown below.

Fabric rinsed with the composition 1A according to the invention have been assessed the grade of 4. Fabric rinsed with composition 1B-1D have been assessed a grade between 5.2 and 6.1.

As such the aqueous composition obtained via the process of the invention is showing improved malodour fighting properties.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as “40 mm” is intended to mean “about 40 mm”.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process to prepare an aqueous composition comprising a non-ionic antibacterial compound having a ClogP above about 2, comprising the steps of:

pre-mixing the non-ionic antibacterial compound having a ClogP above about 2 with an oil to prepare a premix comprising more than about 60% per weight of the premix of oil and of non-ionic antibacterial compound having a ClogP above about 2 and from about 0.4 to about 20% per weight of non-ionic surfactant, mixing the premix with water to obtain an aqueous composition comprising more than about 50% per weight of water.

2. The process according to claim 1, wherein the premix comprises at least about 70% per weight of oil.

3. The process according to claim 1, wherein the oil comprises at least about 50% per weight of perfume oils having a ClogP above about 3.

4. The process according to claim 1, wherein the premix comprises at least about 1% per weight of non-ionic antibacterial compound having a ClogP above about 2.

5. The process according to claim 1, wherein the premix comprises from about 0 to about 20% per weight of water.

6. The process according to claim 1, wherein the aqueous composition comprises:

a) from about 0 wt % to about 5 wt % of anionic surfactant, b) from about 0 wt % to about 3 wt % of cationic surfactant, c) from about 0.4 wt % to about 20 wt % of a non-ionic surfactant, d) from about 0.01 wt % to about 15 wt % of perfume, e) from about 0.01 wt % to about 15% of a non-ionic antibacterial compound having a ClogP above about 2, f) from about 50 wt % to about 99.98 wt % of water.

7. The process according to claim 1, wherein the aqueous composition is a fabric-care composition and comprises from about 0 wt % to about 1.5 wt % of anionic surfactant, from about 0 wt % to about 1.5 wt % of cationic surfactant, from about 0.4 wt % to about 20 wt % of a non-ionic surfactant, from about 0.02 wt % to about 5 wt % of perfume, from about 0.02 wt % to about 5 wt % of a non-ionic antibacterial compound having a ClogP above about 2, and from about 60 wt % to about 99.9 wt % of water.

8. The process according to claim 1, wherein the aqueous composition further comprises from about 0.01 to about 15% of a polymeric thickener.

9. The process according to claim 1, wherein the aqueous composition further comprises from about 0.01 to about 15% of a suds suppressor technology.

10. The process according to claim 1, wherein the aqueous composition has a brookfield viscosity at about 21° C. at about 60 rpm above about 20 cp.

11. The process according to claim 1, wherein the aqueous composition further comprises from about 0.01 to about 15% of perfume-microcapsules.

12. A process to prepare an aqueous composition comprising a non-ionic antibacterial compound having a ClogP above about 2, comprising the steps of:

pre-mixing the non-ionic antibacterial compound having a ClogP above about 2 with an oil to prepare a premix comprising more than about 60% per weight of the premix of oil and of non-ionic antibacterial compound having a ClogP above about 2 and from about 0.01 to about 15% of a polymeric thickener, mixing the premix with water to obtain an aqueous composition comprising more than about 50% per weight of water.

13. The process according to claim 12, wherein the premix comprises at least about 70% per weight of oil.

14. The process according to claim 12, wherein the oil comprises at least about 50% per weight of perfume oils having a ClogP above about 3.

15. The process according to claim 12, wherein the premix comprises at least about 1% per weight of non-ionic antibacterial compound having a ClogP above about 2.

16. The process according to claim 12, wherein the premix comprises from about 0 to about 20% per weight of water.

17. The process according to claim 12, wherein the aqueous composition comprises:

a) from about 0 wt % to about 5 wt % of anionic surfactant, b) from about 0 wt % to about 3 wt % of cationic surfactant, c) from about 0 wt % to about 3 wt % of a non-ionic surfactant, d) from about 0.01 wt % to about 15 wt % of perfume, e) from about 0.01 wt % to about 15% of a non-ionic antibacterial compound having a ClogP above about 2, f) from about 50 wt % to about 99.98 wt % of water.

18. The process according to claim 12, wherein the aqueous composition is a fabric-care composition and comprises from about 0 wt % to about 1.5 wt% of anionic surfactant, from about 0 wt % to about 1.5 wt % of cationic surfactant, from about 0 wt % to about 2 wt % of a non-ionic surfactant, from about 0.02 wt % to about 5 wt % of perfume, from about 0.02 wt % to about 5 wt% of a non-ionic antibacterial compound having a ClogP above about 2, and from about 60 wt % to about 99.9 wt % of water.

19. The process according to claim 12, wherein the aqueous composition further comprises from about 0.01 to about 15% of a suds suppressor technology.

20. The process according to claim 12, wherein the aqueous composition has a brookfield viscosity at about 21° C. at about 60 rpm above about 20 cp.

21. The process according to claim 12, wherein the aqueous composition further comprises from about 0.01 to about 15% of perfume-microcapsules.

* * * * *